United States Patent [19]

Knudson

[11] Patent Number: 4,607,839

[45] Date of Patent: Aug. 26, 1986

[54] SNOW SKI MACHINE

[76] Inventor: Mark M. Knudson, 2762 Blendon Woods Blvd., Columbus, Ohio 43229

[21] Appl. No.: 444,866

[22] Filed: Mar. 4, 1983

[51] Int. Cl.[4] ..... A63B 69/18

[52] U.S. Cl. ..... 272/97

[58] Field of Search ..... 272/97, 144, 145, 146

[56] References Cited

U.S. PATENT DOCUMENTS

| | | | |
|---|---|---|---|
| 2,274,081 | 2/1942 | Mautin | 272/97 |
| 3,547,434 | 12/1970 | Ossenkop | 272/97 |
| 3,591,172 | 7/1971 | Hude | 272/97 |
| 3,641,601 | 2/1972 | Sieg | 272/146 |
| 3,650,528 | 3/1972 | Natterer | 272/57 B |
| 3,704,885 | 12/1972 | Raciunas | 272/57 B |
| 3,707,283 | 12/1972 | Cormier | 272/97 |
| 3,708,163 | 1/1973 | Hynes | 272/97 |
| 3,729,207 | 4/1973 | Reynolds | 272/97 |
| 3,731,919 | 5/1973 | Schurch | 272/57 B |
| 3,791,645 | 2/1974 | Stelma | 272/57 B |
| 3,807,727 | 4/1974 | Ferguson | 272/57 B |
| 3,834,693 | 9/1974 | Poppenberger | 272/97 |
| 3,856,321 | 12/1974 | Solymosi et al. | 280/87.04 R |
| 4,074,903 | 2/1978 | Diez De Aux | 272/16 |
| 4,092,787 | 6/1978 | Kaempfea | 35/29 R |
| 4,101,136 | 7/1978 | Corll | 272/97 |
| 4,402,506 | 9/1983 | Jones | 272/97 |

FOREIGN PATENT DOCUMENTS

| | | | |
|---|---|---|---|
| 280118 | 7/1969 | Australia | 272/97 |
| 632029 | 12/1961 | Canada | 272/97 |
| 2224798 | 11/1973 | Fed. Rep. of Germany | 272/97 |
| 2443695 | 3/1976 | Fed. Rep. of Germany | 272/97 |

*Primary Examiner*—Richard J. Apley
*Assistant Examiner*—S. R. Crow
*Attorney, Agent, or Firm*—Robert B. Watkins

[57] ABSTRACT

The snow ski machine is a snow ski exerciser and teaching aid device which simulates the total motion of downhill parallel skiing minus forward motion consisting of two parallel simulated skis resting on a swivel near the skier's feet with said swivel being a pivot between the skis and a cart which follows two parallel rails horizontally moving from side to side by means of the shifting and transfer of the skier's weight with said cart pulling against two springs mounted on the center front and center back of the cart while the front of the skis rest unattached in guides which follow the angle of the skis on a pivot as the skier moves on the skiing device from side to side.

11 Claims, 12 Drawing Figures

7
9
6
6
10
3
3
4
4
24
22
1
1
2
2
23
19
18
20
20
12
12
14
18
5
5
15
22
21

6
7
6
3
24
4
3
4
2
1
2
1
21
22
18
19
20
14
12
12
33
20
5
23
5
15
21
22
18

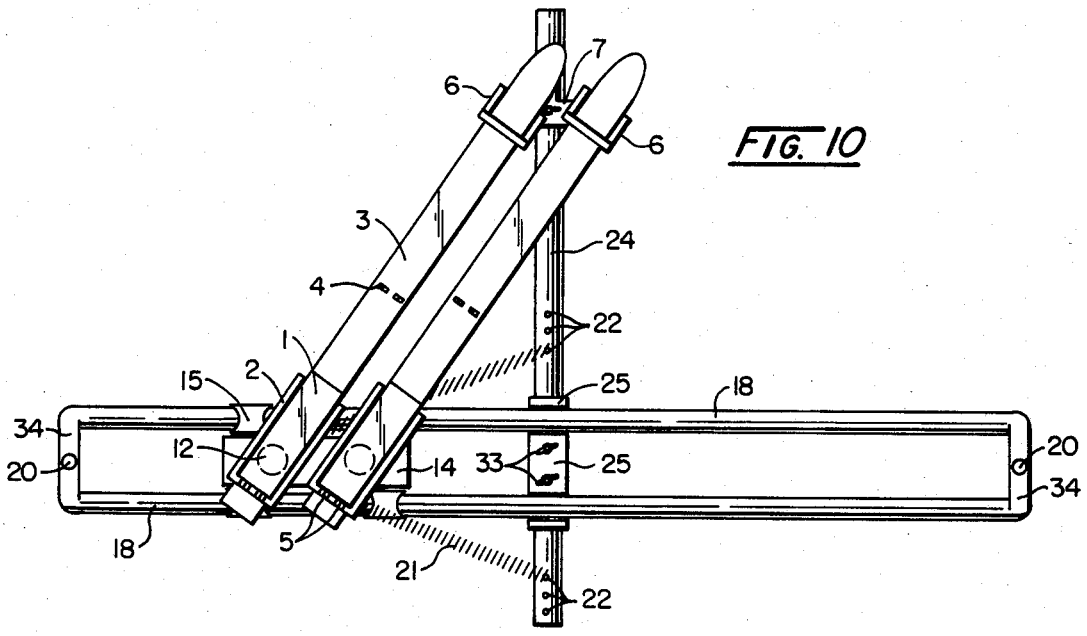
FIG. 10
FIG. 11
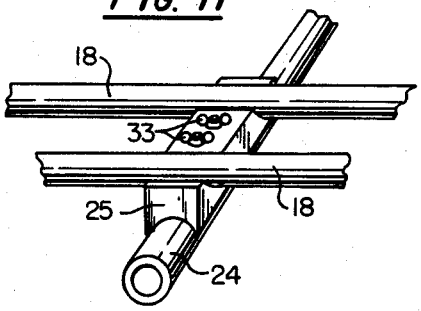
FIG. 12
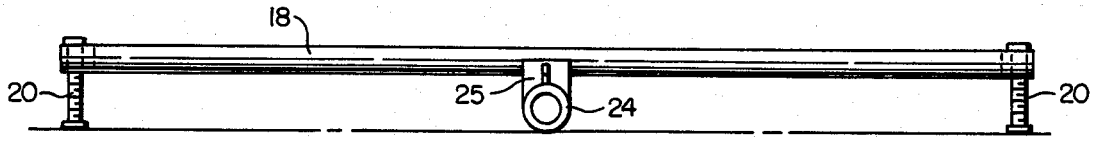

SNOW SKI MACHINE

SUMMARY OF THE INVENTION

The snow ski machine of this invention is a snow ski teaching aid and exercise device which duplicates the total motion of downhill parallel skiing minus the forward movement and therefore is an excellent exercise device and teaching aid in helping one to parallel ski. The major problem in teaching parallel skiing is the many elements a student must learn before he/she is able to combine them into one total motion. Another problem for the student is how he or she is to mix these elements together to produce the smooth and natural motion of parallel skiing. Some of these essential elements are; body positioning or angulation, balance, ski edge control, weight distribution, ski lead change, centrifugal force of a turn, unweighting, timing and forward lean.

Previous inventions in this field have covered some of these elements, but have been unable to produce the sum total motion of parallel skiing. A few of these previous ski simulators have a pivot at the front of the skis, producing an unnatural arc for the skier's feet to follow and causing his weight to be thrown backwards. Several other previous ski inventions eliminate the angle the skis follow through each turn. Still other ski inventions eliminate the natural effect of centrifugal force which plays upon a skier through the turn. The snow ski machine of this invention mixes the said elements of parallel skiing into a smooth side to side motion producing an improved duplication of parallel skiing on the snow.

The ski machine of this invention develops a very important element of snow skiing known as angulation or body positioning by duplicating the same ski angles experienced on the snow through each parallel turn. The ski machine of this invention is able to achieve this better than previous ski inventions because the pivot point of the skis is near and under the skier's feet. This allows his/her feet to follow a straight horizontal line of travel from side to side which is natural to parallel snow skiing.

This snow ski machine also allows the skier to vary the speed of each turn depending on how heavily he throws his weight.

The snow ski machine of this invention also allows a variety of spring tensions which accommodates skiers of different weights.

One main objective of the ski machine of this invention is to help teach a person how to parallel ski in his own home. This snow ski machine can train a person to mix the different said elements of parallel skiing into one smooth side to side motion, thereby duplicating the same type of physical movement encountered while parallel skiing in the snow. When a person adopts the movement he/she learned on the snow ski machine of this invention to actual snow skiing, he/she will have learned to parallel ski much more easily, safer and quicker.

Another main objective of this snow ski machine is to serve as a snow ski exercise device. Some of the previous ski inventions supply their own power and motion for the skier to follow. In actual snow skiing it is the snow skier that supplies the power and motion for each turn, not the skis. This snow ski machine allows the skier to initiate the power each turn which causes him/her to work the specific muscles needed to parallel snow ski. Exercising on the snow ski machine helps one to shape up before each ski season and is an excellent preparation (training device) for ski racing or ski trips.

An advantage of the snow ski machine of this invention is its simplicity and compactness. It can be easily disassembled and stored in a relatively small place while not being used. Another advantage is how economical it is to produce, making it financially feasible to the general public. Still another advantage of the snow ski machine of this invention is its use by the non-skier as an excercise machine for the development of muscle condition, balance and aerobic condition.

DESCRIPTION OF DRAWINGS

FIGS. 1–12

FIG. 1 is a plan top view of the snow ski machine in neutral position.

FIG. 2 is a plan top view of the snow ski machine in right turn position.

FIG. 3 is a perspective view from the rear; without the skis in neutral position and with sides cut away.

FIG. 4 is a top view of the boot clamp unit.

FIG. 5 is a side view of the boot clamp unit.

FIG. 6 is a side view with the front cut away.

FIG. 7 is a rear perspective view of front ski guides with the back cut away.

FIG. 8 is a rear perspective view of the snow ski machine in right turn position with adjustable feet down, and the front cut away.

FIG. 9 is a rear perspective view of the snow ski machine in right turn position with adjustable feet up, and the front cut away.

FIG. 10 is a top view of a second preferred embodiment of the snow ski machine.

FIG. 11 is a perspective cut away view of the second preferred embodiment of this invention with the harness connecting the main support axis 24 with the two parallel rails 1B.

FIG. 12 is a rear view of the parallel rails in the support unit of the second preferred embodiment.

DETAILED DESCRIPTION OF THE PREFERRED EMBODIMENT

Figure 8:
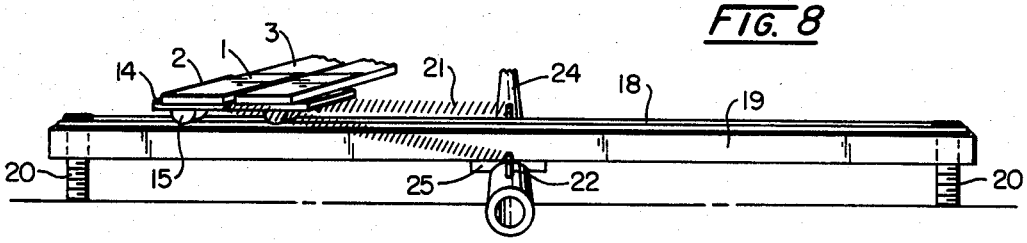
Figure 9:
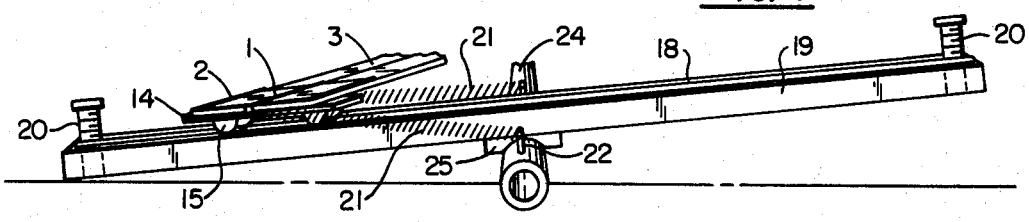

Referring in detail to FIGS. 1 through 3 and 6 of the preferred embodiment, a snow ski machine includes two thick pliable foot pads 1 made of a soft, rubber-like, non-skid surface where the skier places his/her feet. The foot pads 1 are attached on the top of and near the rear of two assimilated skis 3 which move parallel from side to side. The foot pads 1 are surrounded by rails 2 on the right, rear and left sides to prevent the skier's feet from sliding off and are extended slightly above the surface of the foot pads 1. Each ski 3 is attached near the rear on a ball bearing swivel 12 which acts as a pivot between the skis and the cart 14. The ball bearing swivels 12 are attached to the top surface of the cart 14 by means of the swivels center bolt 13. The cart 14 rides on four concave ball bearing wheels 15 which follow along two parallel rails 18 as the cart 14 moves from left to right. The four concave wheels 15 are attached to each end of the two axles 16 mounted on the left and right underside of the cart 14 fastened there by the axle mounts 17. The two parallel rails 18 are attached to a support board 19 having two adjustable feet 20 on each end displayed in FIG. 8 and FIG. 9. These adjustable feet 20 work as large threaded screws and can be set at down, up or intermediate positions. The purpose of these feet 20 is to increase or decrease the depth of the turns and to simulate the pitch of the downhill slope. The support board 19 is mounted on a main support frame/axis 24 perpendicular, and tightly fitted together by the main support axis bracket 25 with two wing nut bolt units 33. The support board 19 pivots with the main support frame/axis when the adjustable feet are retracted. There are two springs 21 mounted on the center front and center rear of the cart by means of cart spring hooks 23. Each of the other ends of the springs are mounted on one or more vertical hooks 22 attached to the main support axis 24. The main support axis hooks 22 are spaced in such a way as to create different spring tensions to accommodate skiers of different weights and are positioned to the front and to the rear of the cart hooks 23 on the main support frame/axis 24. They vary in height so as not to obstruct the movement of the springs 21.

As the skier stands on the foot pads 1 and throws his/her weight from side to side, the cart moves from left to right following along the parallel tracks 18 by means of the concave wheels 15. The skis 3 pivot on the cart 14 by means of the ball bearing swivels 12 located under the skier's feet.

Figure 7:
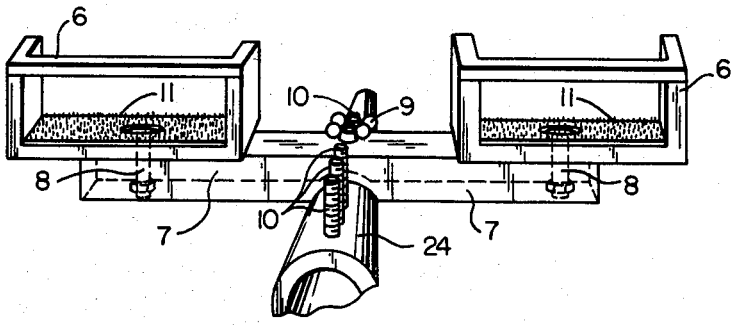

As the skier continues this side to side motion, in order to maintain his/her balance he/she is forced to assume the proper body position used in actual parallel snow skiing. He/she may or may not use ski poles, however ski poles are advised in order to establish the best possible body angulation. The two parallel skis 3 are connected at the ball bearing swivel 12 which acts as the main pivot point while the fronts of the skis 3 are unattached and resting in front ski guides 6. The purpose of these ski guides 6 is to keep the skis 3 parallel and to maintain accurate angles for the skis 3 to follow which would be encountered in actual snow skiing. Each front ski guide 6, as illustrated in FIG. 7, rests on the ski guide support bar 7 by means of a vertical shaft 8 which serves as a vertical axis for the ski guides 6 to pivot on. The front part of each ski 3 rests on the ski guide floor 11 made of carpet or some other nonresistant surface making it easy for the skis 3 to slide on. The skis 3 remain flat in the ski guides 11 surface throughout the operation of the snow ski machine and are free to slide forward or backward through the guides 6 as the skier moves from side to side. The ski guide support bar 7 is firmly attached to the main support frame/axis 24 by means of vertical support bolts 10 which are permanently fixed to the top of the main support axis 24 and hold the ski guide support bar in place by two wing nuts 9 fastened securely. There are a plurality (five shown) of these vertical support bolts 10 to choose from, and the ski guide support bar 7 position may be easily changed by loosening the wing nuts 9 and placing the ski guide support bar 7 on a pair of different vertical support bolts 10 which would vary the angle potential the skis 3 would assume while the snow ski machine is in operation. If the ski guide support bar 7 is moved towards the skier, the potential angle of the skis 3 will be increased. If the ski guide support bar 7 is moved away from the skier, the potential angle of the skis 3 will be decreased. If the adjustable feet 20 are in an up position, causing the wheel rail support board 19 to tilt on the main support axis 24, the ski guide support bar 7 will also tilt to the same degree, leaving the skis 3 resting flat on the ski guide floor 11 at all times. The inside edges of the ski guides 6 will be slightly wider than the skis 3 that rest in them allowing easy forward and backward movement between these two said parts.

Figure 1:
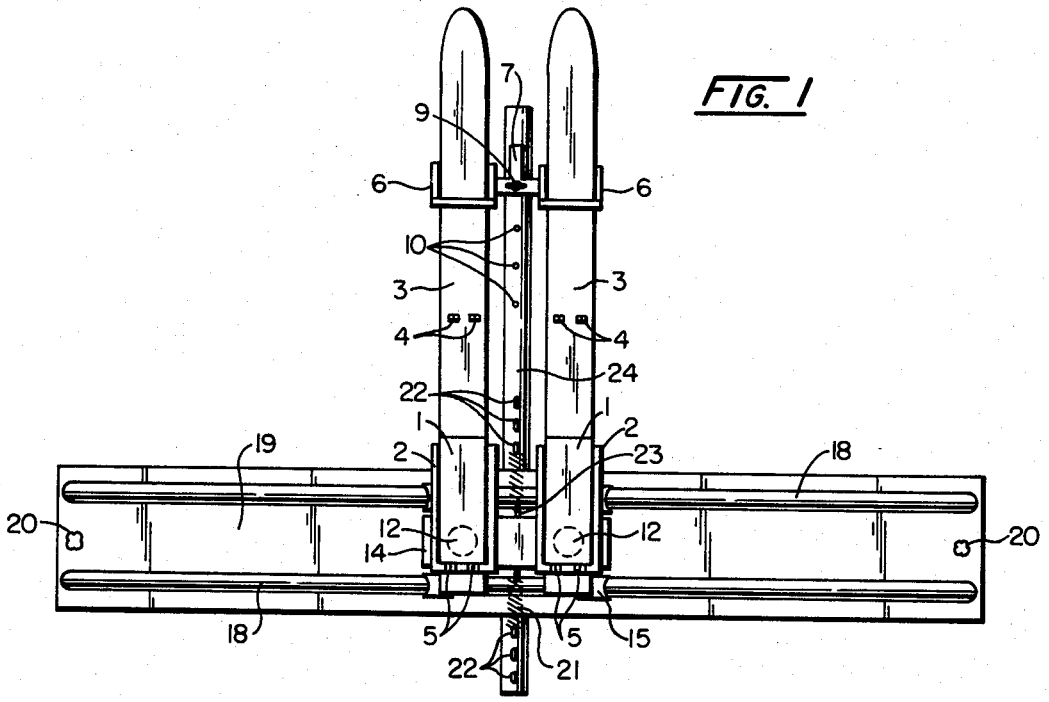
Figure 2:
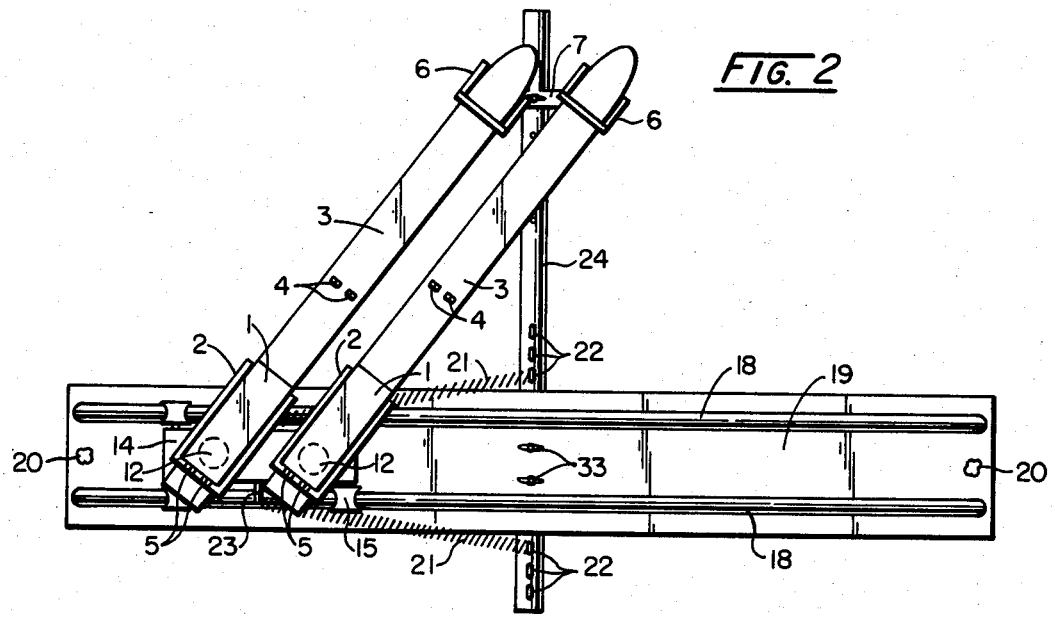
Figure 3:
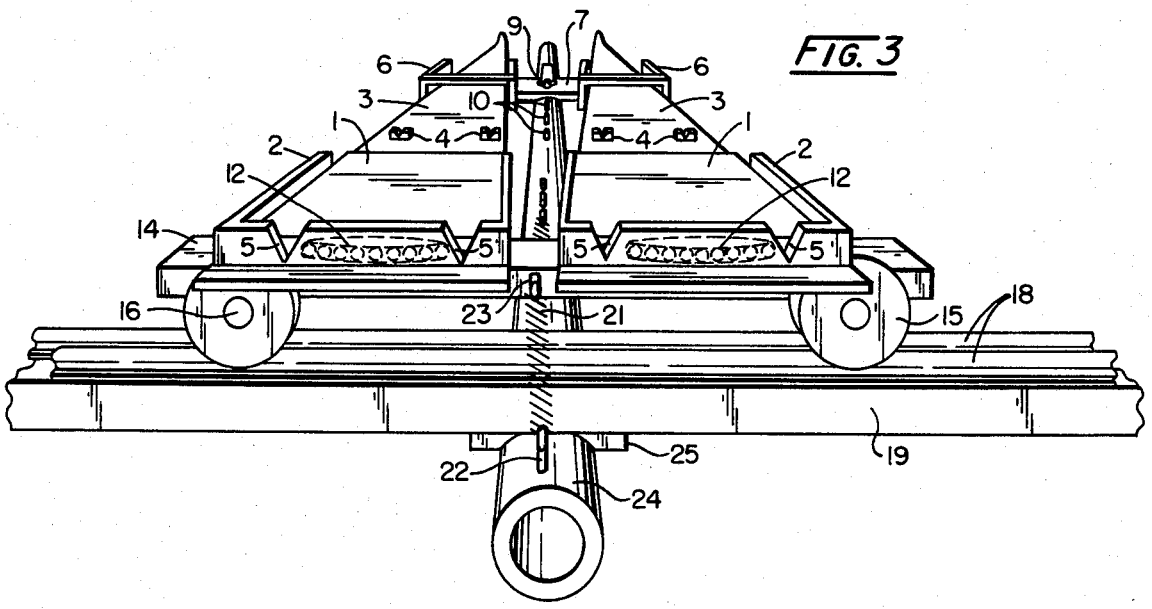
Figure 4:
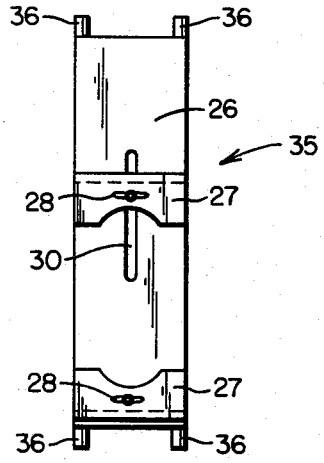
Figure 5:
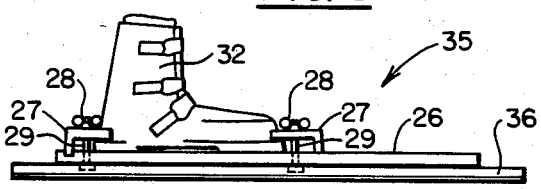
Figure 6:
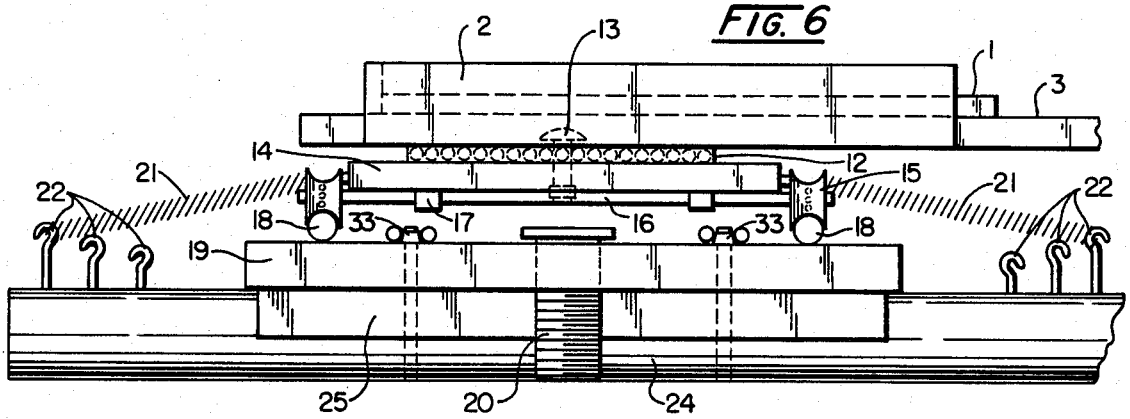

A skier may use the snow machine of this invention with or without the use of shows and may also use ski boots with or without the use of the ski boot clamp support board as shown in FIG. 4 and FIG. 5. It is advised to begin using this snow ski machine to develop his skill without ski boots in a safe and easy fashion. When the ski boots are used on the snow ski machine of this invention, it will then increase the skier's skill and give him/her an extremely accurate assimilation to downhill parallel snow skiing.

As the skier places his/her feet on the soft pliable foot pads, his/her feet will pivot on the edges of his/her shoe, duplicating the pivot of a ski against the snow known as edging. The soft foot pad helps the skier's foot or shoe to edge, due to the nature of its consistancy. Some previous ski inventions have a pivot point directly under the center of the foot and others have two foot pedals directly connected, allowing for no independent action. The snow ski machine has a more improved duplication of actual snow skiing because the true pivot point for edging is established at the right or left edge of both feet independently. The skier may use his/her ski boots on the foot pad 1 causing the right and left edges of the ski boot to pivot horizontally agains the foot pads 1. The skier may also use his/her ski boots in the ski boot clamp board which supplies added stability and forward lean capability.

The skier's ski boots fasten into the boot clamp support board units 35, FIGS. 4 and 5, which fit down over the foot pads 1 by means of boot clamp board pegs 36 fitting into notches 4 and 5 on the skis 3.

The boot clamp support boards 26 each have two boot clamp peg rods 31 fastened on either side. These peg rods 31 extend slightly past the boot clamp support board 26 allowing four extensions on each boot clamp support unit which are called boot clamp support board pegs 36. These pegs 36 fit down into the boot clamp support board notches 4 and 5 found on the top of the skis 3. The ski boot 32 is fastened onto the boot clamp support board 26 with the ski boots 32 heel placed under the rear boot clamp 27 while the front boot clamp 27 is moved back against and over the ski boot toe. The front boot clamps 27 and rear boot clamps 27 are then tightened down by means of wing nuts 28 turning clockwise on fixed vertical bolts 29. The adjustment slot 30 allows the front boot clamp 27 to move forward and backward to accommodate different sized ski boots. When the skier has fastened his/her ski boots into the boot clamp support board units he/she places the front and rear boot pegs 31 into the front boot clamp and rear boot clamp notches 4 and 5. The rear boot clamp notches 5 are slots cut into the rear foot pad rails 2 and the front boot clamp notches 4 are fastened on the top of the skis 3 near the front of the foot pads 1. As the skier rides on the snow ski machine from side to side with his/her ski boots mounted on the boot clamp support board units FIG. 4 and FIG. 5, the boot clamp pegs 36 pivot horizontally in the boot clamp notches 4 and 5 from left to right and help to hold the skier's boots firmly in place. The said boot clamp support board units also allows the skier to slightly lean forward because they extend out past the front of the ski boots. If the skier loses his/her balance while operating the snow ski machine he/she can quickly step off of the assimilated skis 3 with the boot clamp support boards still fastened to his ski boots. Because of the shortness of the boot clamp boards he/she is able to catch his/her balance quite easily.

The snow ski machine of this invention could be made from various types of material such as plastics, metals, or wood. The resilient springs 21 used will both be of relative tension and heavy enough to accommodate a skier of any size. The snow ski machine can be easily disassembled by unhooking both springs 21 lifting the skis 3 off the parallel rails 18 and out of the ski guides 6. The wheel rail support unit 19 will lift off of the main support frame/axis 24 by unfastening the wing nuts 33 from vertical bolts running from a fixed position on the mian support frame/axis 24 up through two holes in the wheel rails support unit 19. The ski guide support bar 7 is unfastened in similar fashion by the wing nuts 9.

It should be understood that the detailed description and the figure drawings presented here are given by way of illustration and not limitation and that variations and changes in detailed construction of the parts may be made within the general scope of the invention. The just described embodiment of the snow ski machine of this invention is a preferred one due to its simplicity and marketability. A second preferred form of the snow ski machine involves changes on the parallel rails 18 and the concave ballbearing wheel 15 show in FIGS. 10, 11 and 12.

The parallel rail support unit consists of two parallel rails 18 connected at both ends by two cross bars 34. A harness 25 is attached to and connects the parallel rails 18 at their central point. The said harness 25 fits down over the main support axis 24 by means of two vertical bolts 33 facing up from and permanently fixed to the main support axis and running through two holes in the harness 25 and is secured there by two wing nuts 33. These parallel rails 18 are made of strong enough material to support the weight of a heavy person without bending the said rails while the snow ski machine is in operation. There are adjustable feet 20, which may be raised or lowered through the center of each cross bar 34 located at the right and left ends of the parallel rails 18. The concave ball bearing wheels 15 will be such a size as to accurately fit over each parallel rail 18 allowing the concave wheels 15 to follow along the parallel rails 18 securely.

The foregoing descriptions and drawings are considered as illustrative only of the principles of the invention. Since a number of modifications and changes may take place it is not desired to limit the invention to the exact construction and operation shown and described. Accordingly, all suitable modifications may be resorted to following within the spirit and scope of the invention.

What I claim is:

1. A snow ski machine which serves as an exercise device and a snow ski training device comprising:

(a) a main support frame having a central axis aligned generally from front to rear of the device;

(b) at least one track-like secondary support means mounted substantially perpendicular to the main support frame/axis, the support means being tiltable from side to side about the main axis;

(c) a movable cart supported on the track-like support means and movable thereon from one side of the main axis to the other;

(d) resilient means connected between the main support frame/axis and the movable cart to urge the cart to a central position over the main support frame/axis on the track-like support means;

(e) a pair of assimilated skis pivotally mounted in substantially side by side position on the said cart;

(f) a front ski guide means mounted on the main support frame/axis at a position removed from the secondary support means including guides to slidably maintain the assimilated skis in parallel position relative to each other when the cart is moved upon the track-like support means; and (g) surface means on each ski to receive a foot of a person using the device to support the weight of the person, the movable cart being movable from one side of the main support frame/axis to the other side of the main support frame/axis, responsively to shifts in the center of weight distribution of the person, while being progressively resisted by the resilient means at a greater distance from the main support frame/axis, in assimilation of down hill parallel snow skiing.

2. The apparatus of claim 1 in which the main support frame is a horizontal shaft serving as a support and horizontal axis for both the perpendicular at least one parallel track, which is centered near the rear of the main support frame, and a ski guide support means, centered near the front of said main support frame; with the at least one track, and the ski guide support means tiltable together relative to the position of the movable cart on the at least one track.

3. The apparatus of claim 2 in which the at least one track is mounted perpendicularly over and near the rear of the main support frame, making it easily removable for easy storage and having vertically adjustable feet located at each end determining the angle of tilt, the track and ski guides support means assumes across the main support frame.

4. The apparatus of claim 1 in which the movable cart travels along the track from side to side by means of contoured wheels fitting the track.

5. The apparatus of claim 1 in which each of the resilient means between the main support frame and the movable cart consists of springs.

6. The apparatus of claim 1 in which the two assimilated skis pivot on a vertical axis on the movable cart.

7. Apparatus of claim 6 in which the vertical axis between the pivot of the assimilated skis and the movable cart is located near the rear of the assimilated skis.

8. The apparatus of claim 1 in which footpads are provided on the skis, made of a pliable non-skid material allowing a users feet to horizontally pivot on the right and left edges of each foot independently.

9. The apparatus of claim 1 in which boot clamp boards are provided on the surface means on top of the skis, each having an adjustable clamp to accomodate different size ski boots and each foot clamp board extending out past the front of the ski boot to allow for a forward lean to the posture of the user, and to allow the boot clamp boards to have freedom to pivot on their left and right edges, and also allowing the user the freedom to step off the skis in case he loses his balance.

10. The apparatus of claim 1 in which the ski guides support the front section of the assimilated skis, keeping the skis parallel and allowing the skis to slide forward and backward through the ski guides, while the ski guides maintain the ever changing angles of the assimilated skis, while the snow ski machine is in operation.

11. The apparatus of claim 10 in which the ski guide support means may be moved forward or backward and attached at different positions along the main support frame, increasing or decreasing the potential angulation between the skis and the main support frame.

* * * * *